US008607384B2

(12) United States Patent
Hornbach

(10) Patent No.: US 8,607,384 B2
(45) Date of Patent: Dec. 17, 2013

(54) BED FRAME ASSEMBLY WITH A LIFT SYSTEM HAVING A TRANSLATABLE CARRIAGE

(75) Inventor: David W Hornbach, Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 330 days.

(21) Appl. No.: 12/967,440

(22) Filed: Dec. 14, 2010

(65) Prior Publication Data

US 2012/0023673 A1 Feb. 2, 2012

Related U.S. Application Data

(60) Provisional application No. 61/369,337, filed on Jul. 30, 2010.

(51) Int. Cl.
*A47B 7/02* (2006.01)

(52) U.S. Cl.
USPC ..... 5/611; 5/610

(58) Field of Classification Search
USPC ..... 5/11, 600, 610, 611
See application file for complete search history.

(56) References Cited

U.S. PATENT DOCUMENTS

| | | | | |
|---|---|---|---|---|
| 5,074,000 | A * | 12/1991 | Soltani et al. | 5/611 |
| 6,912,746 | B2 * | 7/2005 | Grove | 5/618 |
| 6,978,500 | B2 * | 12/2005 | Osborne et al. | 5/600 |
| 2008/0047068 | A1 * | 2/2008 | Zakrzewski | 5/611 |
| 2008/0289108 | A1 * | 11/2008 | Menkedick et al. | 5/610 |
| 2010/0050343 | A1 * | 3/2010 | Hornbach et al. | 5/611 |

* cited by examiner

*Primary Examiner* — Robert G Santos
*Assistant Examiner* — Richard G Davis
(74) *Attorney, Agent, or Firm* — Kenneth C. Baran

(57) ABSTRACT

A bed frame assembly includes a base frame 32, an elevatable frame 40 and a lift system 80. The lift system includes a carriage 82 longitudinally translatably mounted on the base frame and a lift arm 84 having a crank end 86 and a remote end 88. The crank end of the lift arm is mounted to the carriage at a pivotable joint A for pivoting about a laterally extending crank axis 100. The remote end of the lift arm is connected to the elevatable frame by a lift arm connector 102, which may take various forms. The lift system also includes an actuator 120 mounted on the carriage at a juncture B and connected to the lift arm such that operation of the actuator rotates the lift arm about the crank axis. The lift system also includes a part span connector 130 pivotably connected to the lift arm at a joint D and pivotably connected to the base frame at a joint C. In one embodiment the lift arm connector is a single link 132. In another embodiment the lift arm connector comprises multiple links such as first and second links 144, 146.

14 Claims, 15 Drawing Sheets

BED FRAME ASSEMBLY WITH A LIFT SYSTEM HAVING A TRANSLATABLE CARRIAGE

TECHNICAL FIELD

The subject matter described herein relates to beds having a base frame and an elevatable frame and particularly to the lift system used to govern the vertical elevation of the elevatable frame relative to the base frame.

BACKGROUND

Beds used in hospitals, other health care facilities and home care settings may have a base frame and an elevatable frame. Such beds also include a lift mechanism for adjusting the height of the elevatable frame relative to the base frame between a maximum elevation and a minimum elevation. It is desirable for the lift mechanism to be compact in order to make efficient use of the limited space between the base frame and the elevatable frame. Compactness may also assist the bed designer in achieving a sufficiently low minimum elevation of the elevatable frame. Compactness and the architecture or layout of the lift system may also provide space that bulky interframe components can occupy, particularly when the vertical separation between the frames is small, thereby further enhancing the ability to achieve a satisfactorily low minimum elevation of the elevatable frame.

SUMMARY

A bed frame assembly includes a base frame, an elevatable frame, and a lift system. The lift system includes a carriage, longitudinally translatably mounted on the base frame, and a lift arm mounted to the carriage at a pivotable joint A and connected to the elevatable frame by a lift arm connector. The lift system also includes an actuator mounted on the carriage at a juncture B and connected to the lift arm such that operation of the actuator rotates the lift arm about a crank axis. The lift system also includes a part span connector pivotably connected to the lift arm at a joint D and pivotably connected to the base frame at a joint C.

BRIEF DESCRIPTION OF THE DRAWINGS

The foregoing and other features of the various embodiments of the bed frame assembly described herein will become more apparent from the following detailed description and the accompanying drawings in which.

DETAILED DESCRIPTION

Figure 1:
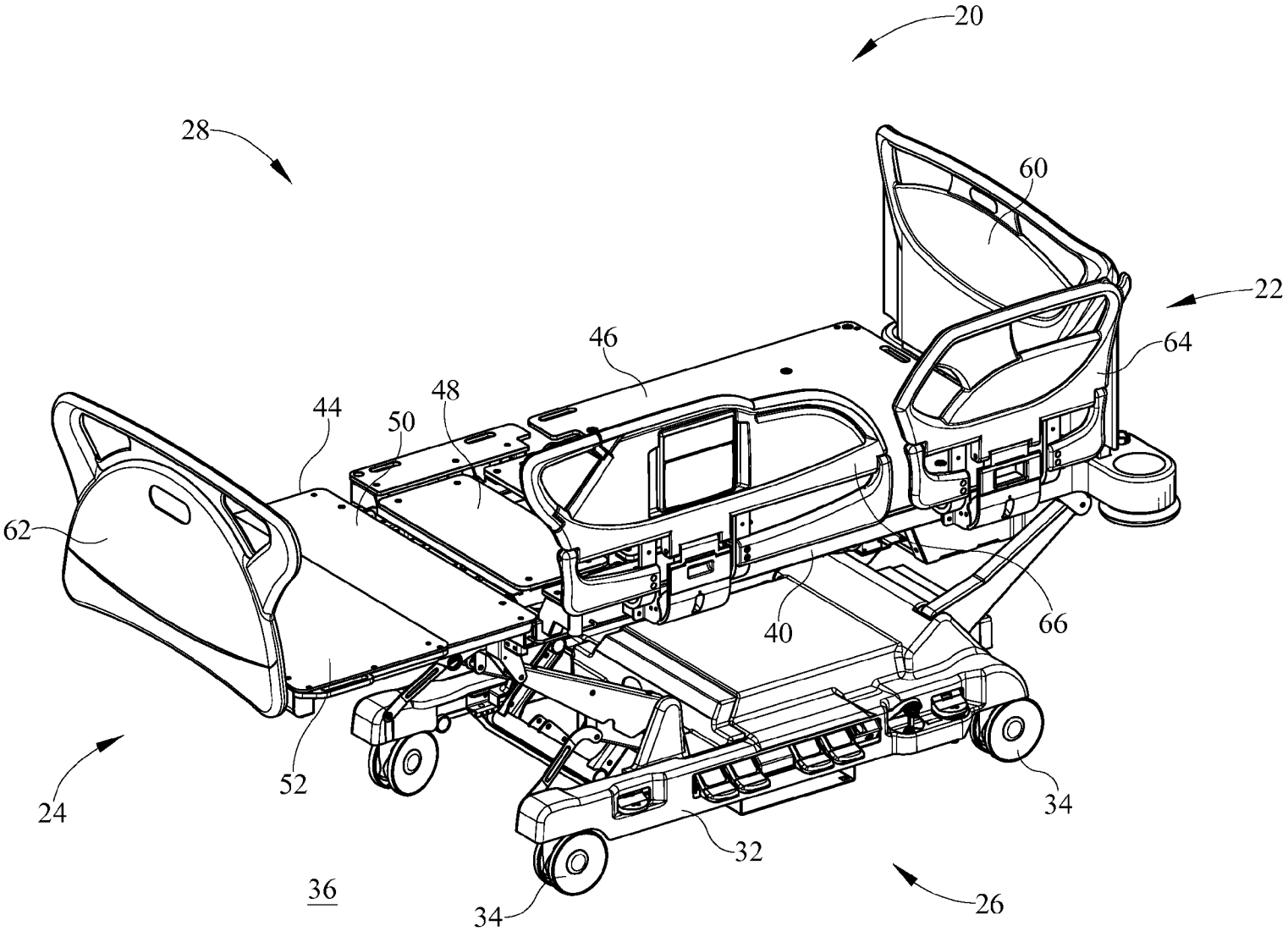
FIG. 1 is a perspective view of a hospital bed having a base frame, an elevatable frame and a segmented deck, the bed being shown in a horizontal configuration.
Figure 2:
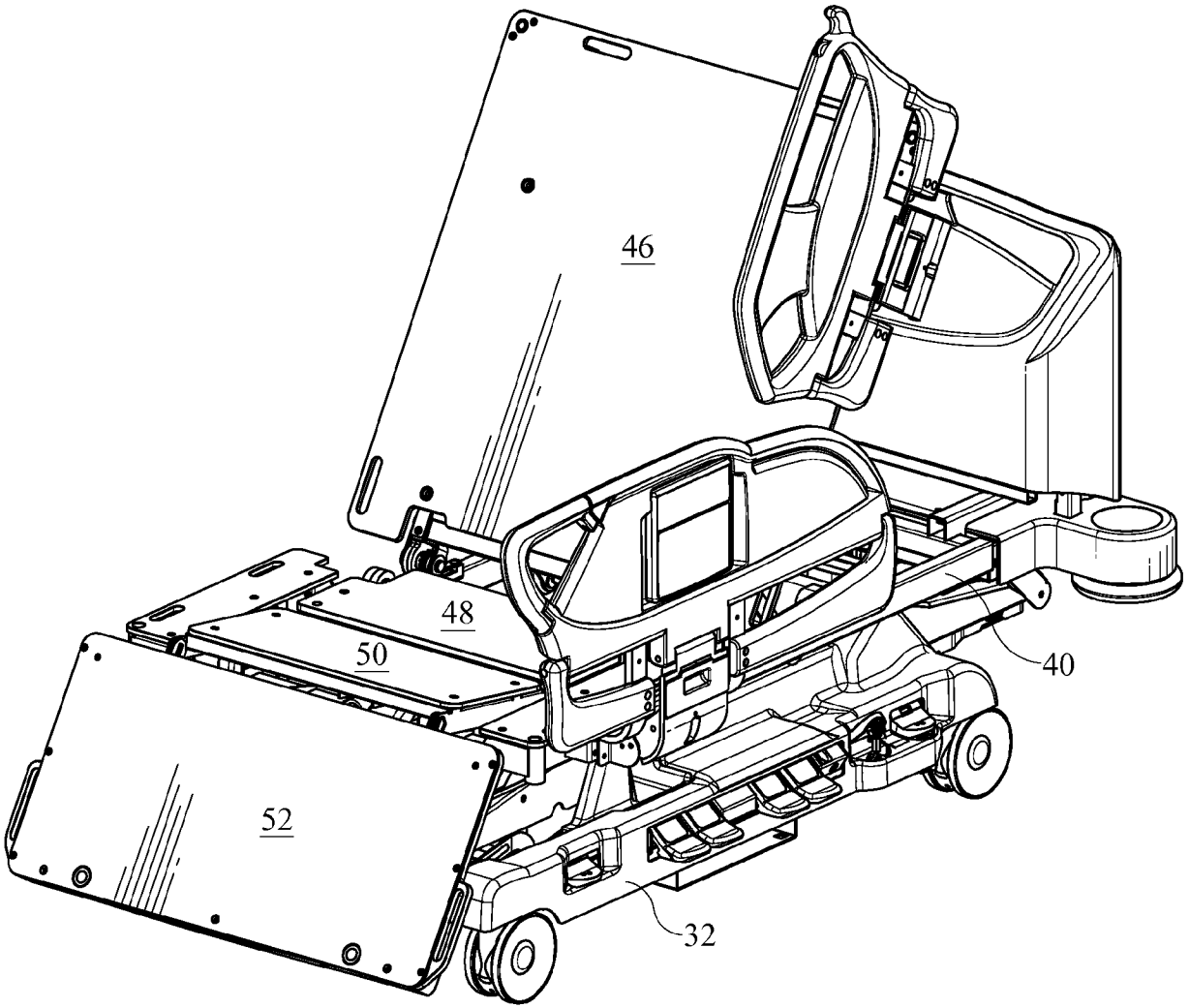
FIG. 2 is a perspective view of the bed of FIG. 1 in a chair configuration.

FIGS. 1 and 2 show a hospital bed 20 having a head end 22, a foot end 24 longitudinally spaced from the head end, a left side 26 and a right side 28 laterally spaced from the left side. The bed includes a bed frame assembly comprising base frame 32 with casters 34 extending to the floor 36, and an elevatable frame 40 supported on the base frame. The elevation of the elevatable frame can be adjusted relative to the base frame. The bed also includes a deck 44 supported on the elevatable frame. The illustrated deck is a segmented deck comprising a torso or upper body section 46, a seat section 48, a thigh section 50 and a calf section 52. The angular orientation of the upper body, thigh and calf sections can be adjusted to achieve a variety of desired bed profiles. A mattress, not shown, rests on the deck. The bed also includes a headboard 60 affixed to the elevatable frame and a footboard 62 affixed to the calf deck section. The bed also includes a left side head end siderail 64, a left side foot end siderail 66, a right side head end siderail, not shown, and a right side foot end siderail, also not shown. As is evident from FIG. 2 the bed can be placed in at least one chair configuration which may or may not be suitable for facilitating occupant ingress or egress.

Figure 3:
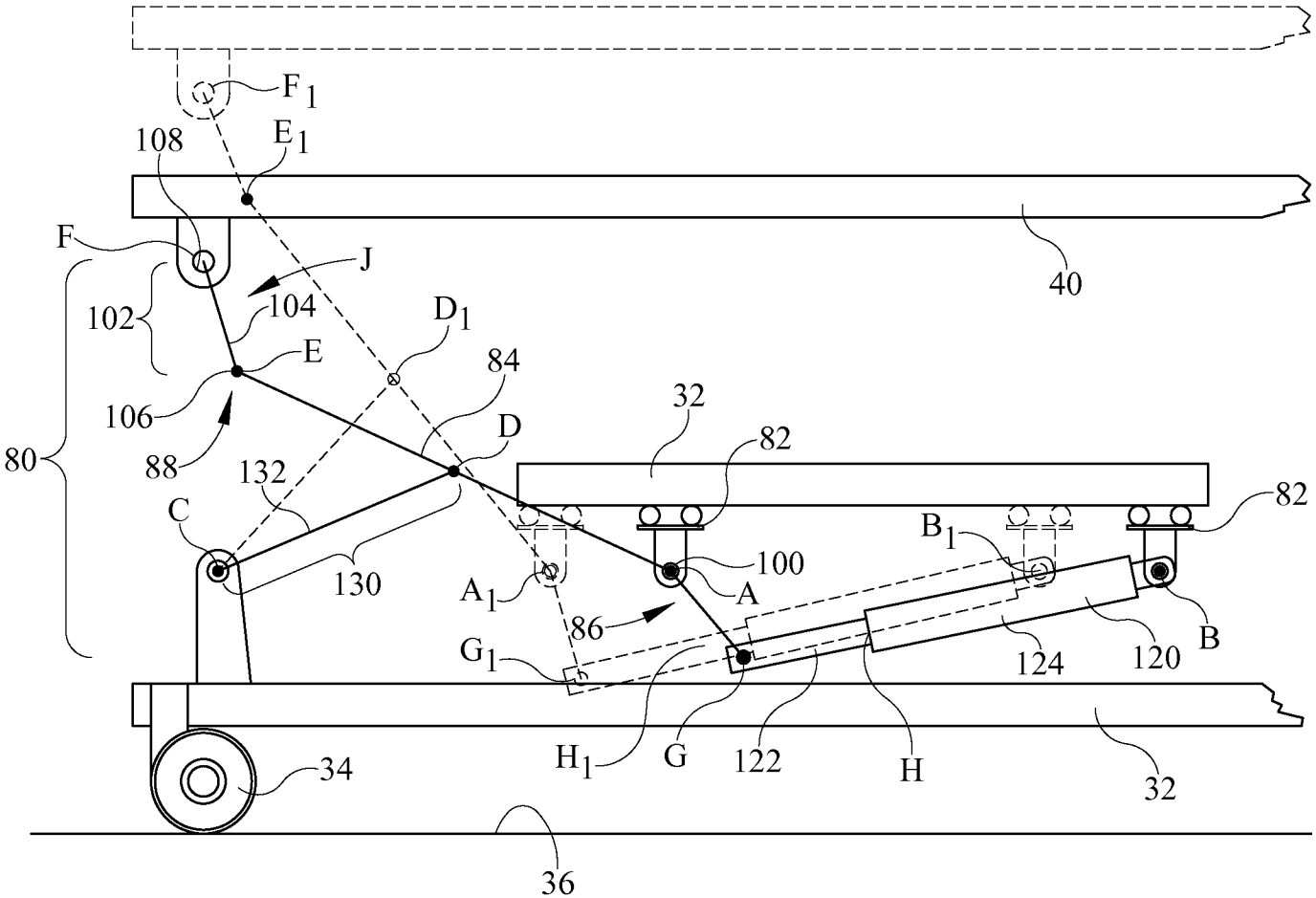
FIG. 3 is a schematic, right side elevation view of a first embodiment of a bed frame assembly described herein with a lift system and the elevatable frame shown in a first position (solid lines) and a second position (broken lines).
Figure 4:
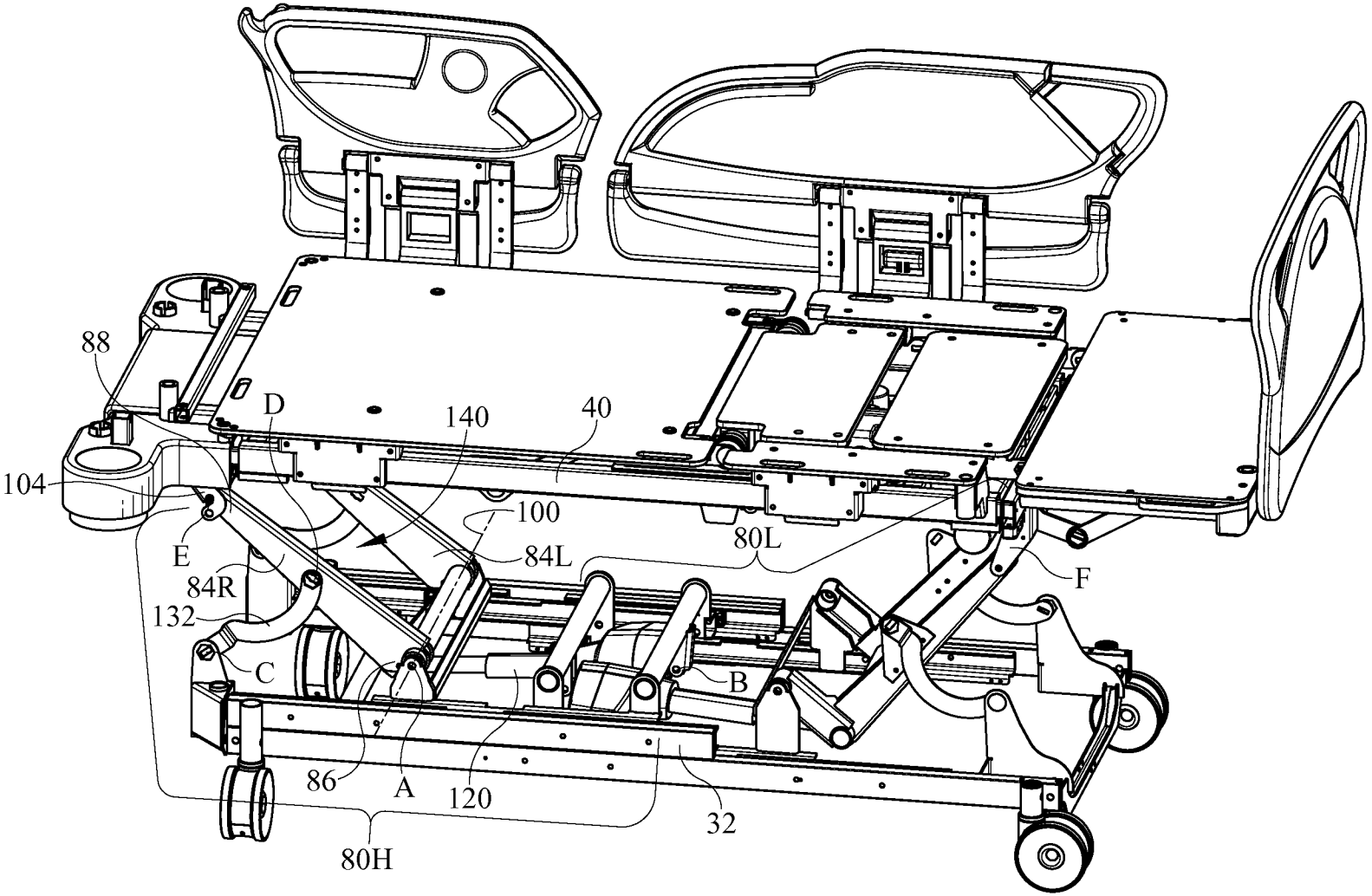
FIG. 4 is a right side perspective view of a prototype of the first embodiment of the bed frame assembly described herein as seen by an observer looking from a location above the bed.
Figure 5:
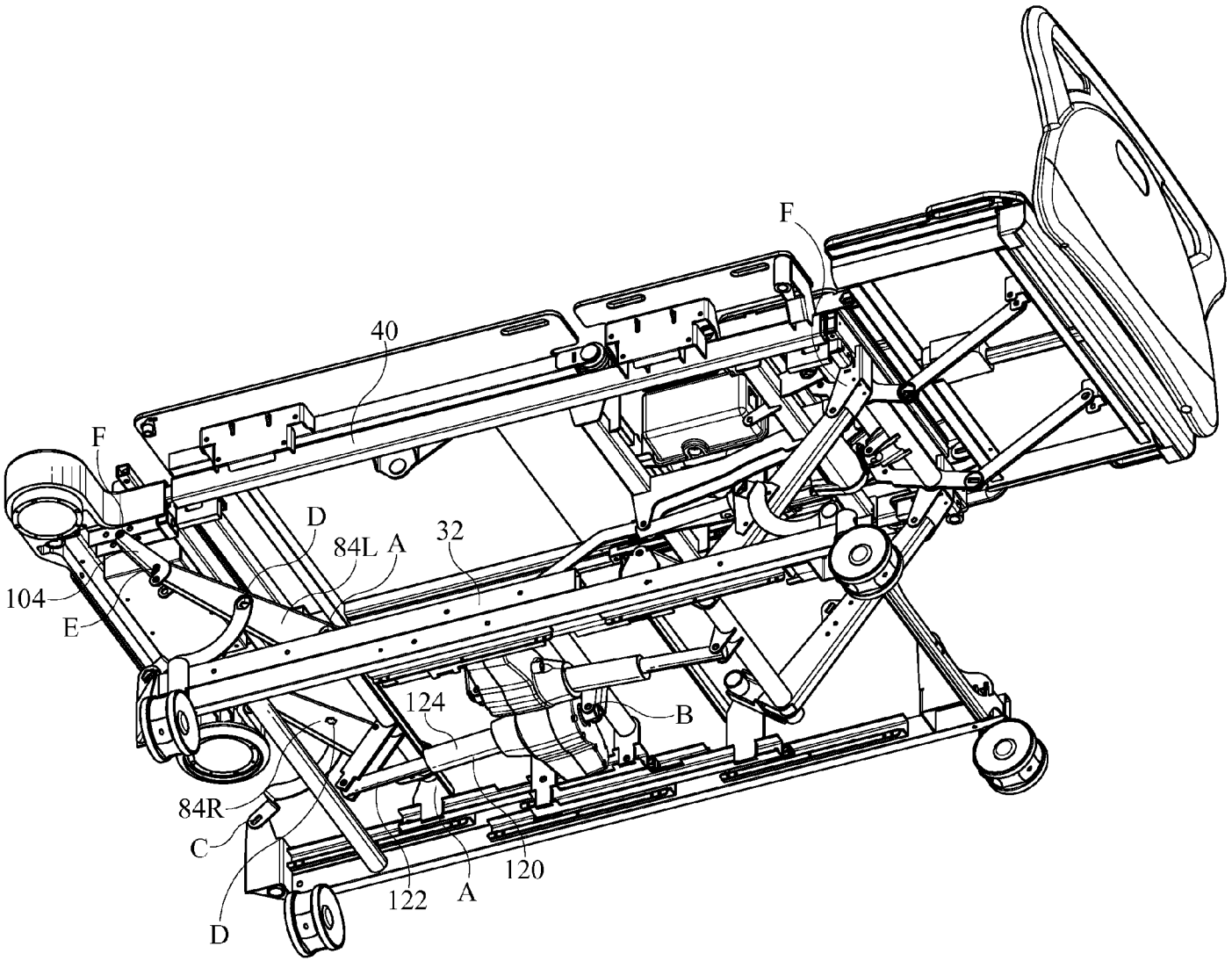
FIG. 5 is a view similar to that of FIG. 4 as seen by an observer looking from a location below the bed.

Referring FIGS. 3-10 and principally to FIGS. 3 and 4, the bed frame assembly also includes a lift system 80 shown in a first position (solid lines of FIG. 3) and a second position (broken lines of FIG. 3). The lift system comprises a carriage 82 longitudinally translatably mounted on the base frame 32, for example by sliders or rollers. The lift system also includes a lift arm 84 having a crank end 86 and a remote end 88. The crank end of the lift arm is mounted to the carriage at a pivotable joint A so that the crank arm is pivotable about a laterally extending crank axis 100. The remote end of the lift arm forms a junction J with a lift arm connector 102 thereby connecting the remote end 88 of the lift arm 84 to the elevatable frame. In the embodiment seen in FIGS. 3-10, the lift arm connector comprises an auxiliary link 104 having a lift arm end 106 and a frame end 108. The lift arm end of auxiliary link 104 is pivotably connected to the remote end of the lift arm at a pivotable joint E; the frame end of the auxiliary link is pivotably connected to the elevatable frame at a pivotable joint F. In a variant of the lift system the connector is a single pivotable joint F. This is seen best in FIG. 6 where frame 40 includes an extension 114 welded by weld 112.

The lift system also includes an actuator 120 mounted on the carriage at a juncture B and connected to the lift arm such that operation of the actuator rotates the lift arm about crank axis 100. In the embodiment of FIGS. 3-10, the actuator is a linear actuator, juncture B between the actuator and the carriage is a pivotable joint B, and the actuator is connected to the lift arm 84 at a pivotable joint G. Joint G is spaced or offset from crank axis 100 to provide a moment arm (the distance from G to A) allowing the actuator to easily rotate the lift arm as actuator piston 122 extends further out of or retracts into actuator housing 124.

The lift system also includes a part span connector 130. In the embodiment of FIGS. 3-10 part span connector 130 is a single link 132 pivotably connected to the lift arm at a joint D and pivotably connected to the base frame at a joint C, which is at substantially the same elevation relative to the floor as joint A. Joint D is separated from junction J (as represented by joint E of FIG. 3 or joint F of FIG. 6) by a distance DJ, joints A and D are separated from each other by a distance AD, and joints C and D are separated from each other by a distance CD. Joints A and D and junction J (as represented by joint E of FIG. 3 or joint F of FIG. 6) lie on a straight line. The distances DJ, AD and CD are substantially equal to each other.

Figure 6:
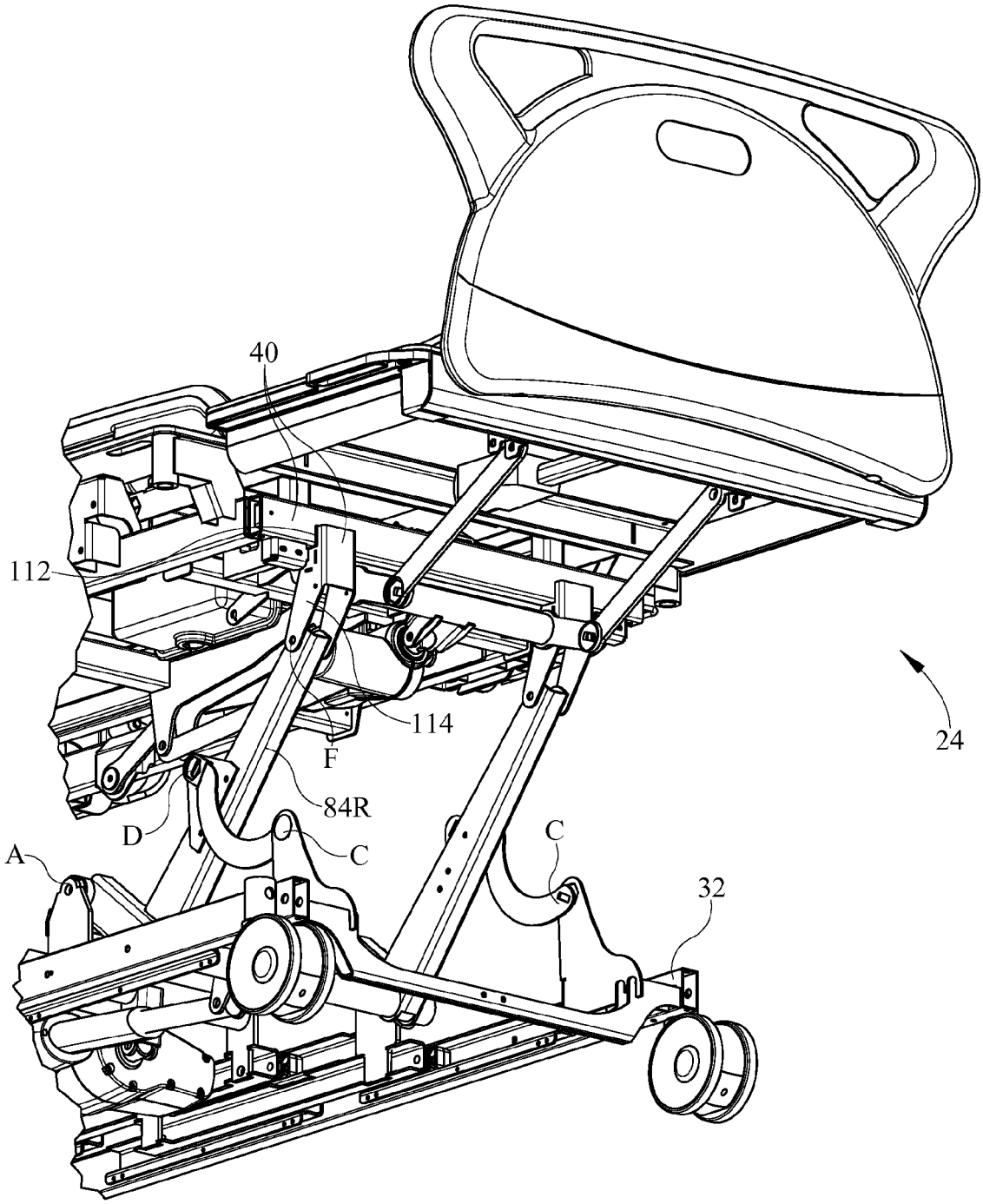
FIG. 6 is a close-up view of the bed frame assembly seen in FIGS. 4-5 showing part of a foot end lift system including a remote end of a foot end lift arm and a lift arm connector in the form of a pivotable joint.

A commercially practical version of the bed frame assembly includes a head end lift system 80H and a foot end lift system 80L (as seen in FIG. 4) with the head end lift system employing a lift arm connector in the form of auxiliary link 104 whose lift arm end is pivotably connected to the remote end of the lift arm at a pivotable joint E and whose frame end is pivotably connected to the elevatable frame at a pivotable joint F (FIG. 5), and with the foot end lift system employing a lift arm connector in the form of a single pivotable joint F (FIG. 6). Alternatively, the lift system with the auxiliary link could be used at the foot end of the frame and the lift system with the single-joint could be used at the head end. In yet another alternative, both lift systems could employ the lift arm connector having the auxiliary link.

In use, operation of actuators 120 changes the vertical separation of the elevatable frame relative to the base frame so that the elevatable frame can be elevated to a fully raised state or elevation, lowered to a fully lowered state or elevation, or positioned at a selected elevation between the fully raised and fully lowered elevations. For example, for the initial position shown in FIG. 3 (solid lines) as the head end actuator piston extends out of its housing, the head end lift arm 84 rotates clockwise about its axis 100 at joint A. Head end link 132 constrains the position of head end joint D relative to head end joint C, thereby causing the head end carriage 82 to translate longitudinally in the direction of joint C with the result that joint E moves substantially perpendicularly relative to base frame 32. For some initial positions other than the one shown in FIG. 3, (e.g. if link 132 is initially oriented at an angle below the horizontal) carriage 82 will initially move away from joint C and then later in the direction of joint C. The foot end lift system operates similarly but is oriented so that its lift arm rotates counterclockwise (when viewed from the same side of the bed) thereby causing its carriage 82 to translate longitudinally in the direction of its joint C. In other words during an increase in vertical separation the lift system carriages translate longitudinally toward their respective ends of the bed but, depending on the initial position of the linkages, may initially translate away from their respective ends of the bed. During an increase in vertical separation the carriages translate principally away from their respective ends of the bed. As the elevatable frame approaches its fully lowered elevation, the lift system carriages may undergo a small motion toward their respective ends of the bed. FIGS. 4 and 8-10 are a sequence of views showing the elevatable frame of the bed frame assembly at a relatively high elevation, a moderately high elevation, a moderately low elevation and a fully lowered elevation respectively.

Figure 7:
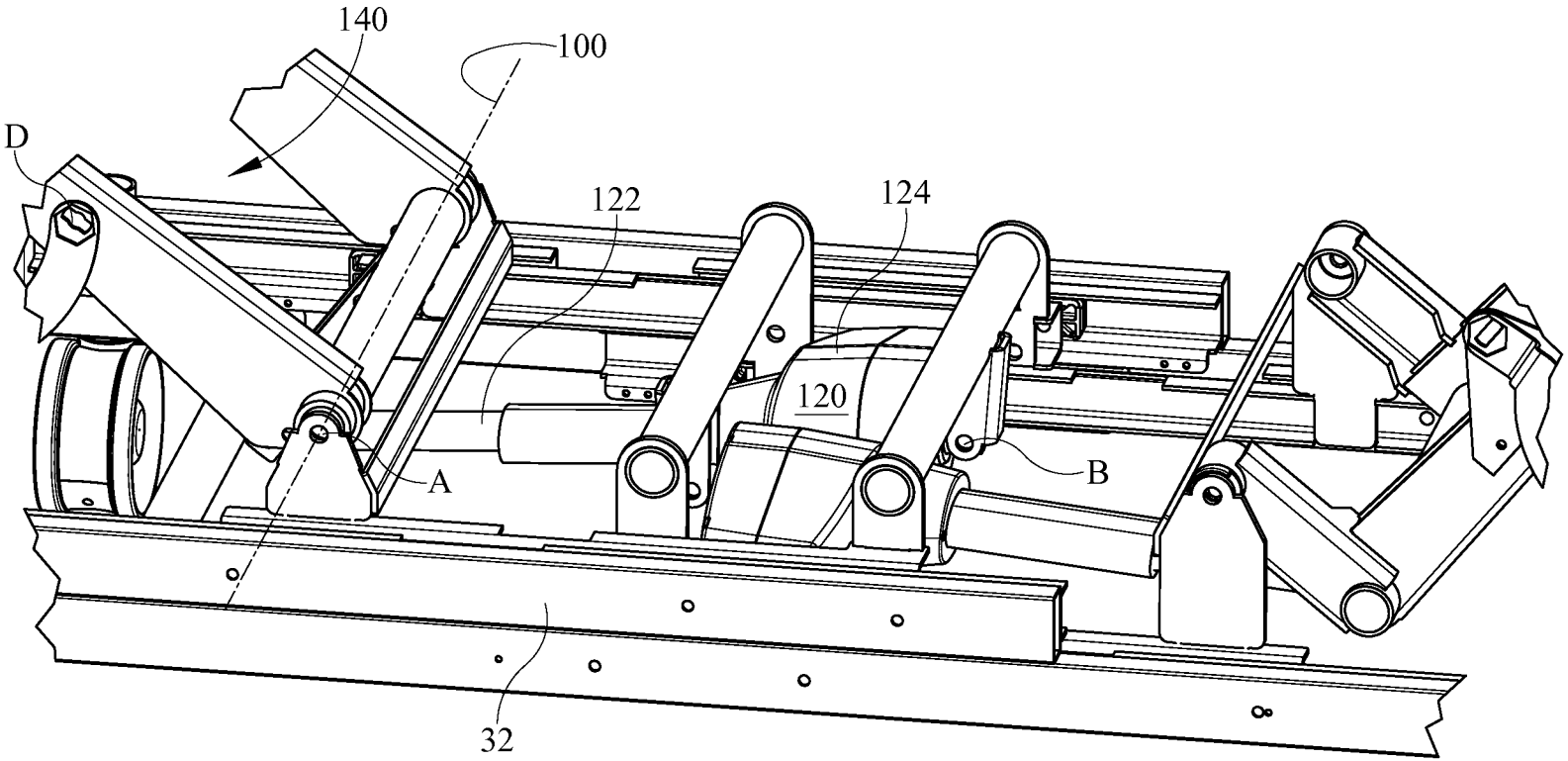
FIG. 7 is a view similar to that of FIG. 4 showing components of the head end lift system in more detail.
Figure 8:
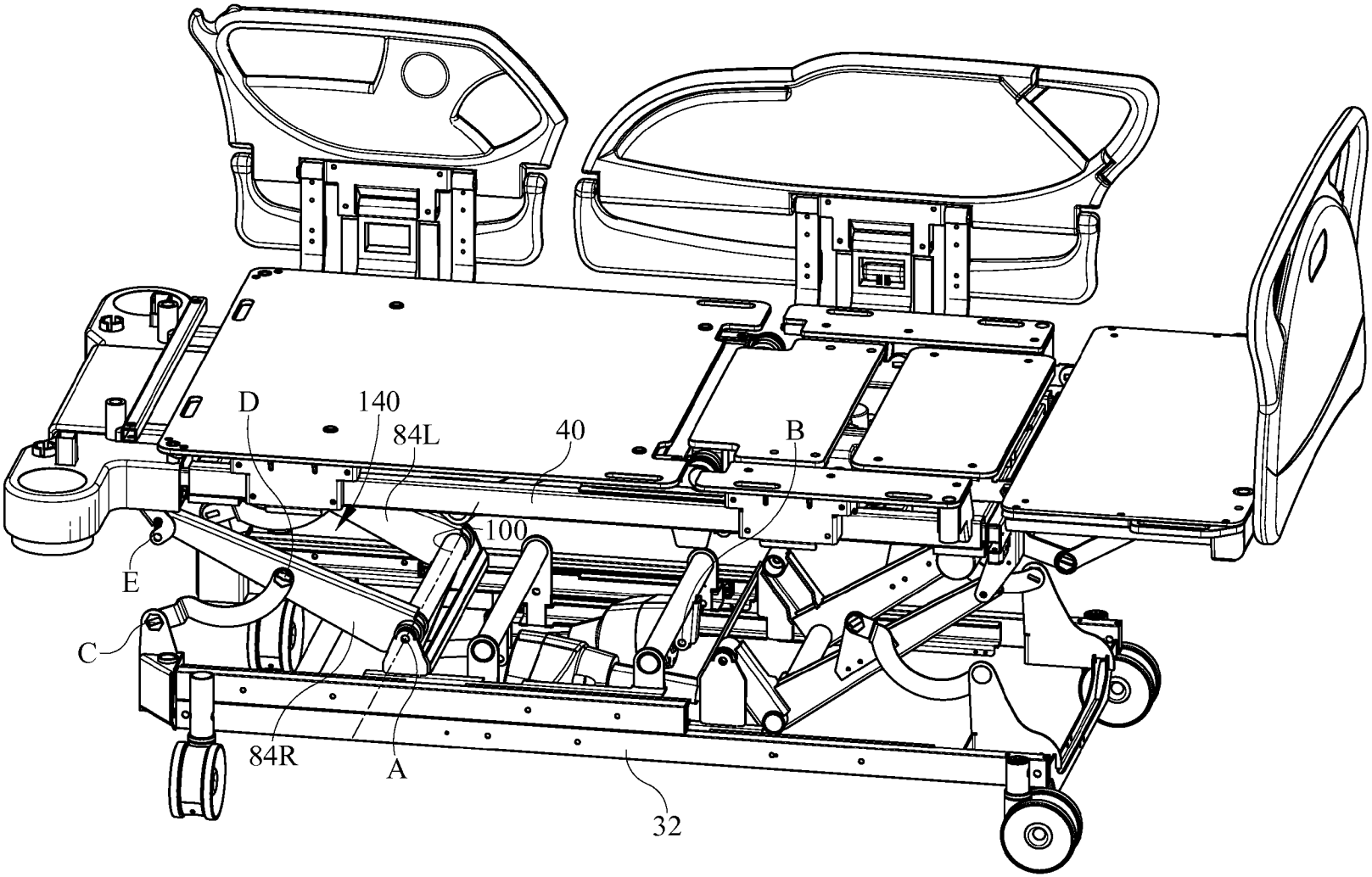
FIGS. 8-10 are a sequence of views similar to that of FIG. 4 showing, in combination with FIG. 4, the elevatable frame of the bed frame assembly at a relatively high elevation, a moderately high elevation, a moderately low elevation and a fully lowered elevation respectively.
Figure 9:
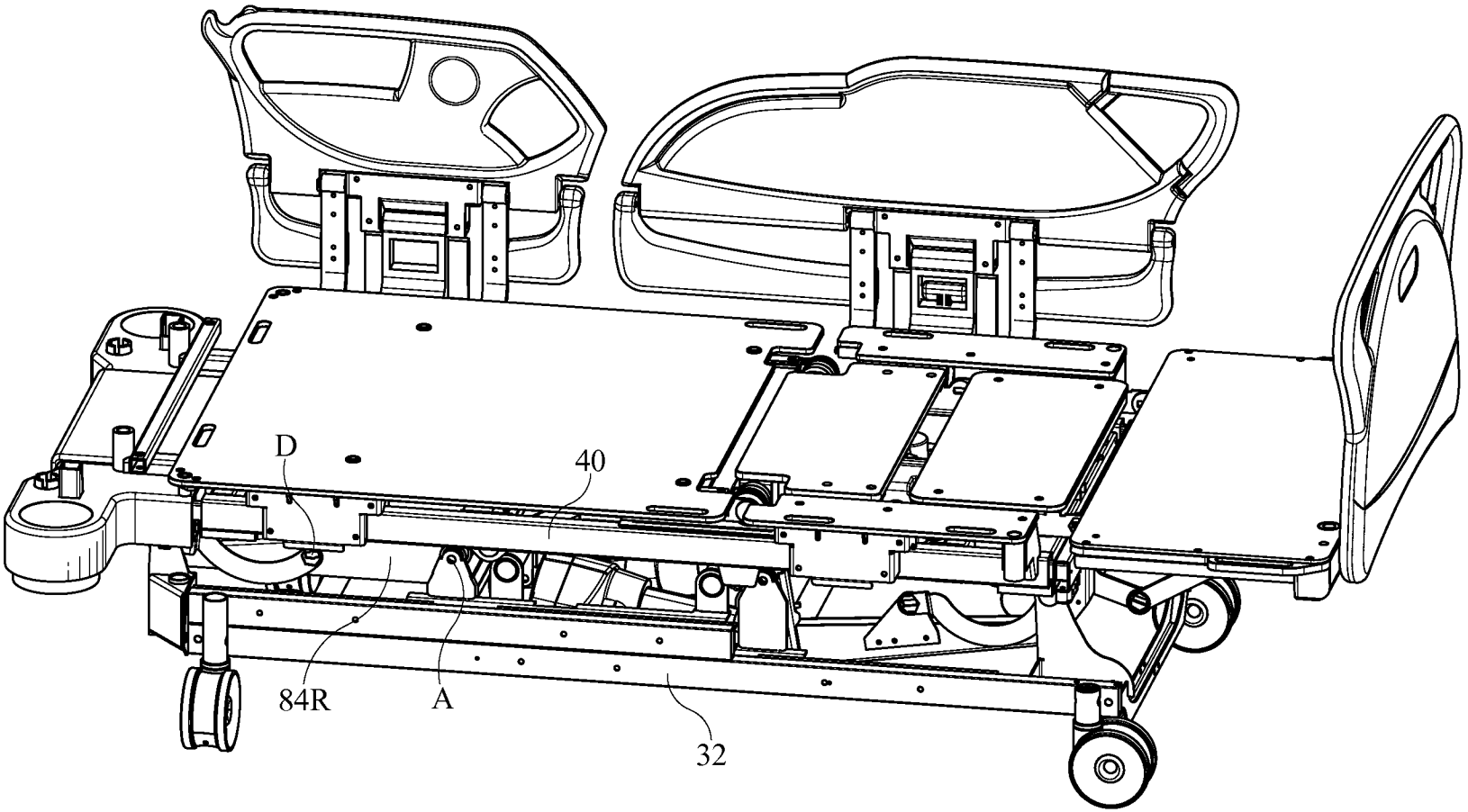
Figure 10:
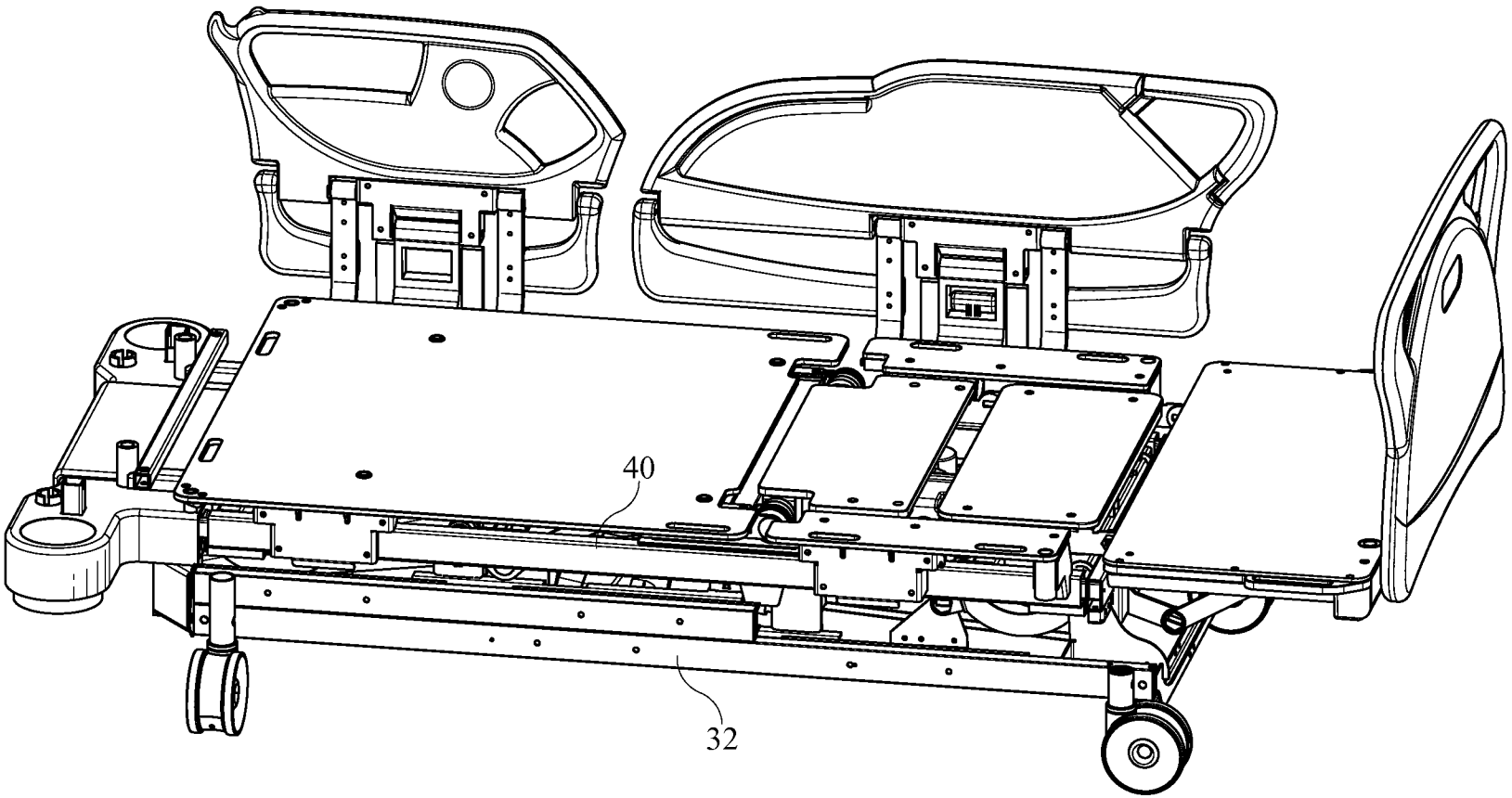

As seen best in FIGS. 4, 7 and 8, the lift system comprises laterally spaced left and right lift arms 84L, 84H. The lift arms and crank axis 100 embrace a void 140 capable of receiving or accommodating the presence of components that vertically approach the base frame as the vertical separation between the elevatable frame and the base frame decreases. Examples of such components include actuators mounted on the underside of the elevatable frame for governing the angular orientation of the deck sections 46, 50, 52. When the elevatable frame is at a relatively high elevation, for example as seen in FIGS. 4, 7 and 8, there is a large volume of space bounded by base frame 32, elevatable frame 40 and the head and food end lift arms 84. This space can be useful for accommodating equipment such as radiological equipment.

The operational demands on actuator 120 can be reduced by ensuring a long moment arm (distance AG) between joints A and G. However doing so can force the system designer to place joint A, and therefore joint C, at a high enough elevation that the fully lowered elevation of the elevatable frame is unsatisfactorily high. A second embodiment of the lift system, shown in FIGS. 11-13 may be effective in overcoming such a limitation.

Figure 11:
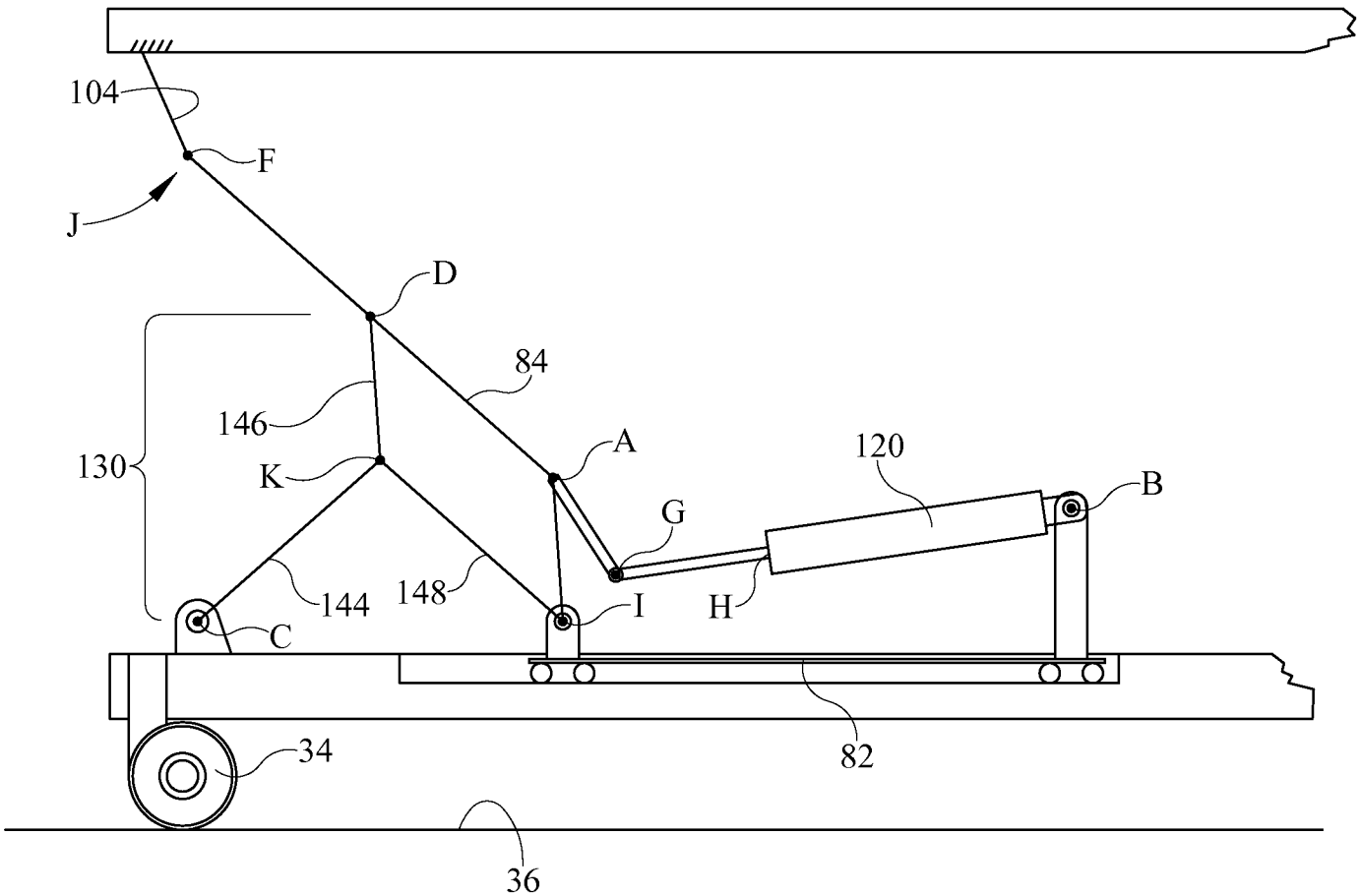
FIG. 11 is a schematic, left side elevation view of a second embodiment of the bed frame assembly described herein showing the foot end lift system and elevatable frame in a first position.
Figure 12:
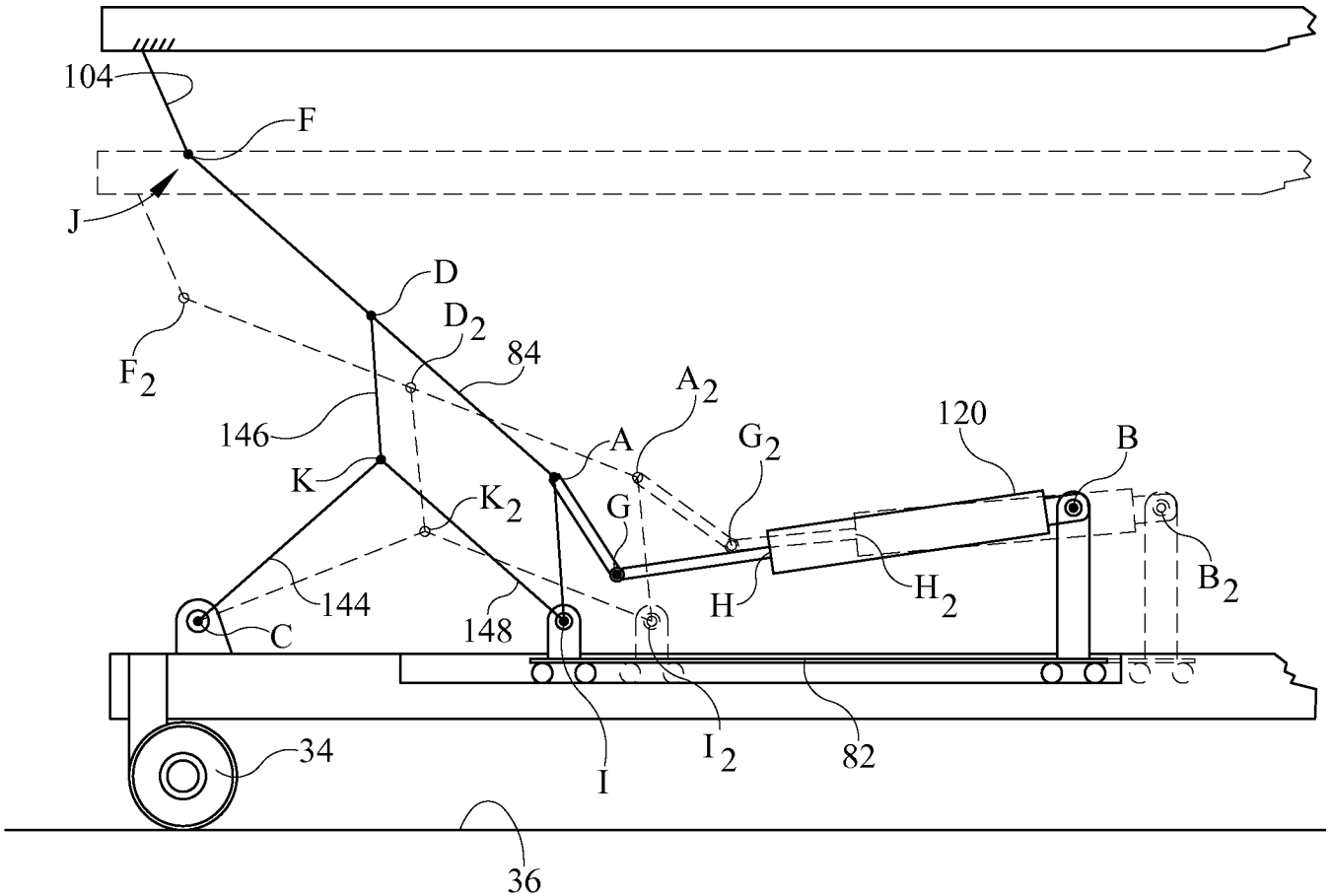
FIGS. 12-13 are views similar to that of FIG. 11 showing the lift system and the elevatable frame in the first position of FIG. 11 (solid lines) in a second position (broken lines of FIG. 12) and in a third position (broken lines of FIG. 13).
Figure 13:
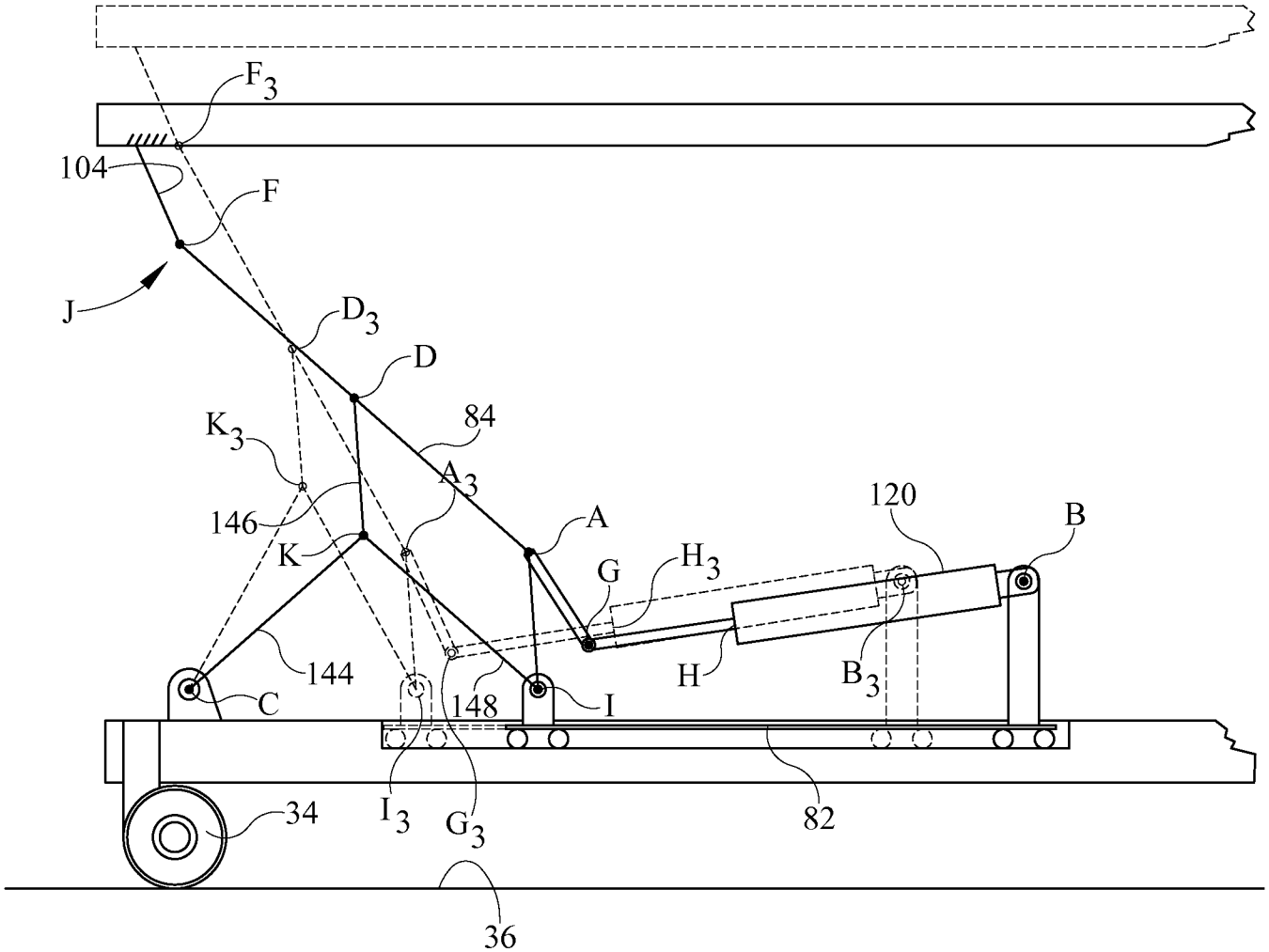
Figure 14:
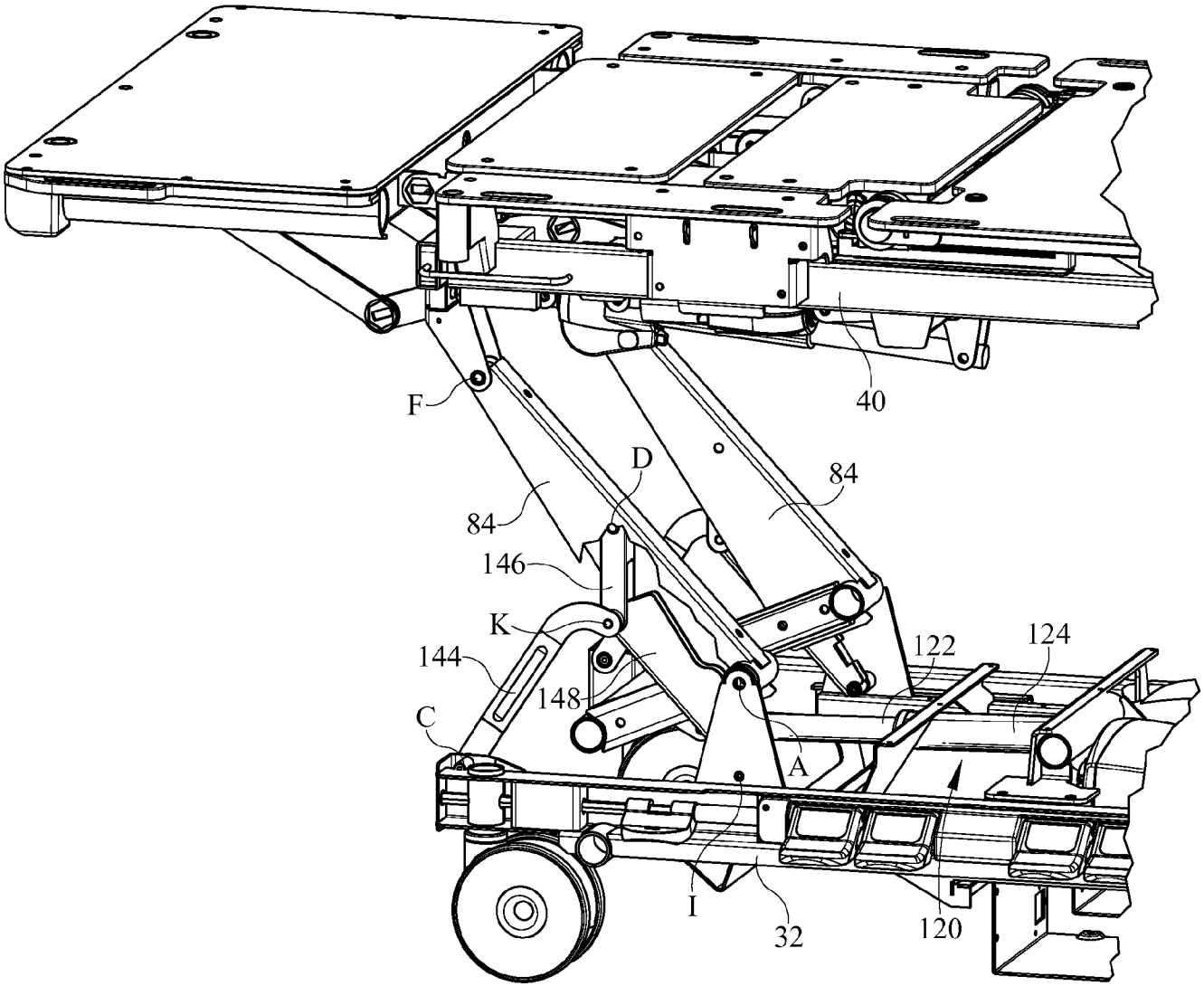
FIG. 14 is a left side perspective view of a prototype of a second embodiment of the bed frame assembly described herein.
Figure 15:
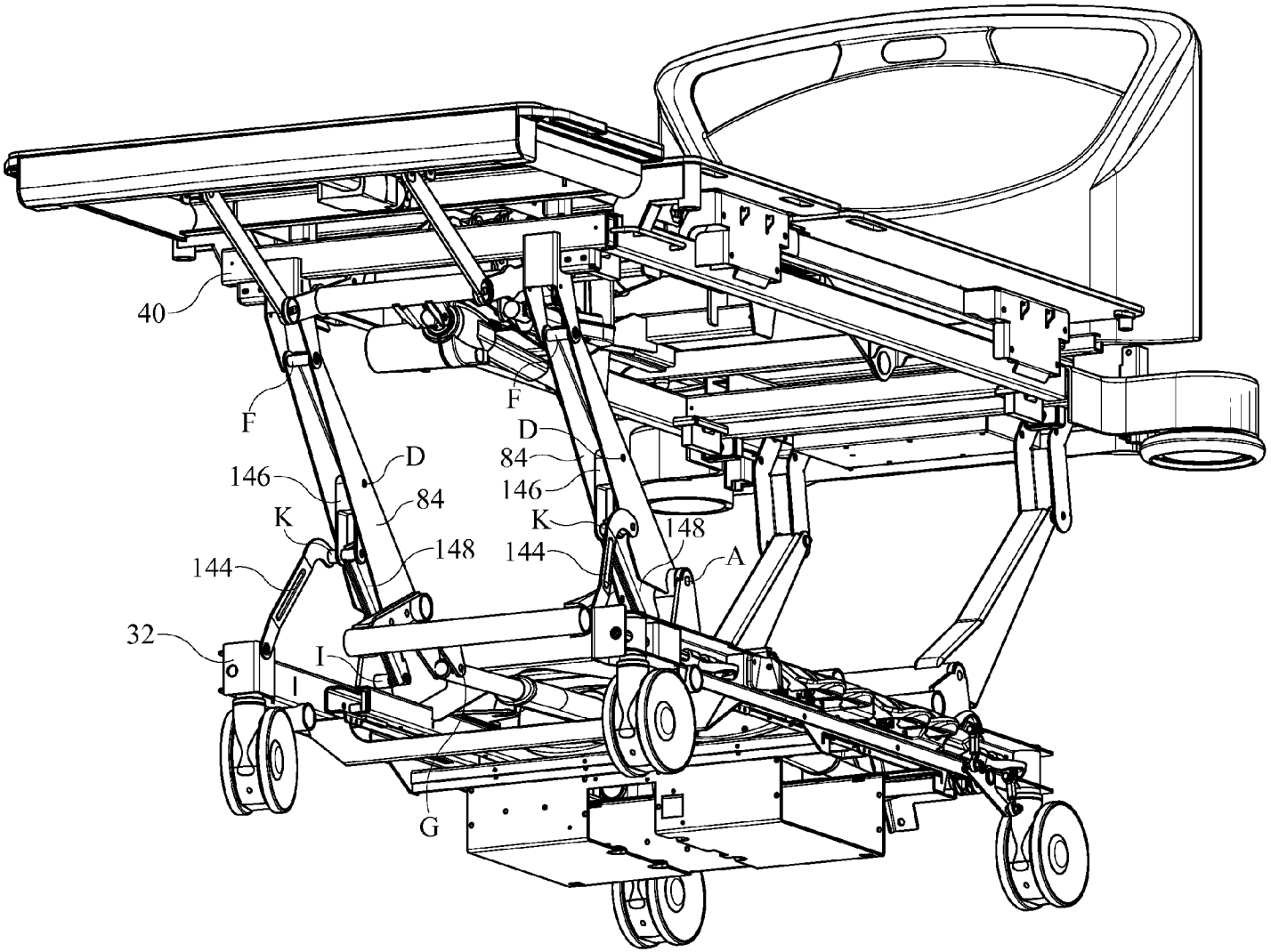
FIG. 15 is a view similar to that of FIG. 14 showing the foot end lift system from a different perspective to render links 146 and 148 more readily visible.

Referring to FIGS. 11-13, the part span connector 130 of the lift assembly of the second embodiment comprises a first link 144 extending from joint C, and a second link 146 extending from joint D. The first and second links are pivotably connected to each other at a common joint K. The lift assembly may also include a third link 148 extending from the common joint K to a joint I that pivotably joins the third link to carriage 82. Joints I and C are at substantially equal elevations. Joints A, D, I and K define corners of a parallelogram. Joint D is separated from junction J (as represented by joint F) by a distance DJ, joints A and D are separated from each other by a distance AD, joints C and K are separated from each other by a distance CK and joints K and I are separated from each other by a distance KI. Distances DJ, AD, CK, and KI are substantially equal to each other.

Although this disclosure refers to specific embodiments, it will be understood by those skilled in the art that various changes in form and detail may be made without departing from the subject matter set forth in the accompanying claims.

I claim:

1. A bed frame assembly comprising:

a base frame;

an elevatable frame; and a lift system comprising:

a carriage longitudinally translatably mounted on the base frame;

a lift arm having a crank end and a remote end, the crank end being pivotably mounted to the carriage at a pivotable joint A for pivoting about a laterally extending crank axis extending through the carriage and the remote end being connected to the elevatable frame by a lift arm connector;

an actuator mounted on the carriage at a juncture B and connected to the lift arm such that operation of the actuator rotates the lift arm about the crank axis; and a part span connector pivotably connected to the lift arm at a joint D and pivotably connected to the base frame at a joint C.

2. The assembly of claim 1 wherein the juncture B is a pivotable joint B.

3. The assembly of claim 1 wherein the actuator is a linear actuator and the juncture B between the actuator and the carriage is a pivotable joint B and the actuator is connected to the lift arm at a pivotable joint G.

4. The assembly of claim 3 wherein joint G is spaced from the crank axis.

5. The assembly of claim 1 wherein the lift arm connector is a pivotable joint F.

6. The assembly of claim 1 wherein the lift arm connector comprises an auxiliary link having a lift arm end and a frame end, the lift arm end being pivotably connected to the remote end of the lift arm at a pivotable joint E and the frame end being pivotably connected to the elevatable frame at a pivotable joint F.

7. The assembly of claim 1 comprising a head end lift system having a head end lift arm connector and a foot end lift system having a foot end lift arm connector, wherein one of the lift arm connectors is a pivotable joint F and the other of the lift arm connectors is an auxiliary link having a lift arm end and a frame end, the lift arm end being pivotably connected to the remote end of the lift arm at a pivotable joint E and the frame end being pivotably connected to the elevatable frame at a pivotable joint F.

8. The assembly of claim 7 wherein the one of the lift systems is the foot end lift system and the other of the lift systems is the head end lift system.

9. The assembly of claim 1 wherein operation of the actuator changes vertical separation of the elevatable frame relative to the base frame between a fully raised state and a fully lowered state, and the assembly comprises two laterally spaced lift arms, the lift arms and the crank axis defining a void capable of accommodating the presence of components that vertically approach the base frame as the vertical separation between the elevatable frame and the base frame decreases.

10. The assembly of claim 1 comprising a head end lift system and a foot end lift system and wherein operation of the actuator changes vertical separation of the elevatable frame relative to the base frame, and wherein the carriages of the lift systems translate longitudinally away from their respective ends of the bed during a decrease in vertical separation and translate longitudinally toward their respective ends of the bed during an increase in vertical separation.

11. The assembly of claim 1 wherein the remote end of the lift arm forms a junction J with the lift arm connector and the junction is separated from joint D by a distance DJ, joints A and D are separated from each other by a distance AD, joints C and D are separated from each other by a distance CD, and the distances DJ, AD and CD are substantially equal to each other.

12. The assembly of claim 1 wherein the lift system comprises a head end lift system and a foot end lift system, one but not both of the head and foot end lift systems comprising:

a carriage longitudinally translatably mounted on the base frame;

a lift arm having a crank end and a remote end, the crank end being mounted to the carriage at a pivotable joint A for pivoting about a laterally extending crank axis and the remote end being connected to the elevatable frame by a lift arm connector;

an actuator mounted on the carriage at a juncture B and connected to the lift arm such that operation of the actuator rotates the lift arm about the crank axis; and a part span connector pivotably connected to the lift arm at a joint D and pivotably connected to the base frame at a joint C;

wherein operation of the actuator changes vertical separation of the elevatable frame relative to the base frame, and wherein the carriage translates longitudinally away from its end of the bed during a decrease in vertical separation and translates longitudinally toward its end of the bed during an increase in vertical separation.

13. The assembly of claim 12 wherein as the elevatable frame approaches a fully lowered elevation during a decrease in vertical separation, the lift system carriage undergo a translation toward its end of the bed.

14. The assembly of claim 13 wherein the translation occurs when the part span connector is oriented at an angle below horizontal.

* * * * *